US012017326B2

(12) United States Patent
Mase et al.

(10) Patent No.: US 12,017,326 B2
(45) Date of Patent: Jun. 25, 2024

(54) POWDER CONTACT MEMBER AND METHOD FOR SURFACE TREATMENT OF POWDER CONTACT MEMBER

(71) Applicant: FUJI MANUFACTURING CO., LTD., Tokyo (JP)

(72) Inventors: Keiji Mase, Tokyo (JP); Shozo Ishibashi, Tokyo (JP); Yusuke Kondo, Tokyo (JP)

(73) Assignee: FUJI MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 18/097,791

(22) Filed: Jan. 17, 2023

(65) Prior Publication Data

US 2023/0150088 A1 May 18, 2023

Related U.S. Application Data

(62) Division of application No. 16/723,013, filed on Dec. 20, 2019, now abandoned.

(30) Foreign Application Priority Data

Mar. 6, 2019 (JP) ..... 2019-040412

(51) Int. Cl.
*B24C 1/08* (2006.01)

(52) U.S. Cl.
CPC ..... *B24C 1/08* (2013.01)

(58) Field of Classification Search
CPC ..... B24C 1/08
See application file for complete search history.

(56) References Cited

U.S. PATENT DOCUMENTS 6,869,334 B1 * 3/2005 Leyendecker ..... B24C 1/08 451/39
7,695,346 B2 * 4/2010 Ishibashi ..... C09K 3/1409 451/39
9,108,295 B2 * 8/2015 Hansson ..... A61L 27/06
2008/0233838 A1 * 9/2008 Mase ..... B24C 11/00 451/38
2012/0043044 A1 * 2/2012 Mase ..... B24C 1/08 164/271
2012/0144890 A1 * 6/2012 Miyasaka ..... C21D 7/06 72/53
2020/0299811 A1 * 9/2020 Seki ..... C25D 11/04

FOREIGN PATENT DOCUMENTS

JP 2006159402 A 6/2006
JP 2017119902 A * 7/2017
JP 2017128101 A * 7/2017
JP 2017186170 A * 10/2017

OTHER PUBLICATIONS

Motojima et al., JP-2017186170-A, Machine Translation. (Year: 2023).*
JP-2017128101-A, Abstract., Machine Translation. (Year: 2023).*
JP-2017119902-A, Abstract, Machine Translation. (Year: 2023).*
https://www.fine-tools.com/G10019.html, Unit Conversion Chart (Year: 2023).*
Japanese Office Action from Corresponding Japanese Application No. 2019-040412, dated Jan. 4, 2023.

* cited by examiner

*Primary Examiner* — Duy Vu N Deo
*Assistant Examiner* — Christopher Remavege
(74) *Attorney, Agent, or Firm* — Ronald M. Kachmarik; Cooper Legal Group LLC

(57) ABSTRACT

A surface treatment method for preventing adhesion of powder to a powder-contacting member having a surface on which contacted powder flows in the form of a particle layer. The method includes performing surface treatment on the surface such that an arithmetic average peak curvature Spc (1/mm) of the surface is 150 to 400, a peak density Spd (piece/mm$^2$) of the surface is 10000 to 180000, a root mean square gradient Sdq of the surface is 0.05 to 0.30, and an arithmetic average height Sa (μm) of the surface is 0.02 to 3.00, and providing a space where an air layer can exist between the particle layer and the surface.

12 Claims, No Drawings

POWDER CONTACT MEMBER AND METHOD FOR SURFACE TREATMENT OF POWDER CONTACT MEMBER

BACKGROUND OF THE INVENTION

1. Field of the Invention

The present invention relates to a powder-contacting member (e.g., a hopper or the like) which is used in a portion with which powder comes into contact in a device or equipment which handles powder in supply, transport, or measure of the powder, and has a surface on which adhesion of the powder is prevented by surface treatment and powder flowability is improved, and a method for surface treatment of a powder-contacting member.

2. Description of the Related Art

Powder usually tends to adhere to the surface of a member with which the powder comes into contact and accumulate on the surface, which causes various problems. For example, in the case where a predetermined amount of powder stored in a hopper is supplied repeatedly, when the powder adheres to the surface of the hopper and accumulates, a problem arises in that the flow rate of the powder becomes unstable and the predetermined amount of the powder cannot be supplied repeatedly.

To cope with this, various inventions for solving the problems caused by the adhesion and the accumulation of the powder described above are proposed.

For example, Japanese Patent No. 4064438 discloses the invention relating to a steel member for a powder handling apparatus which enhances capability to cause powder to peel and slip down from a steel surface by providing predetermined protrusions and recesses on the steel surface with which the powder comes into contact to thereby prevent adhesion of the powder. Specifically, there is disclosed the steel member for a powder handling apparatus having a surface with which the powder including a particle or a particle aggregate having an average particle diameter or an average outer diameter of 20 μm or less comes into contact. Additionally, on the surface with which the powder comes into contact, the predetermined protrusions and recesses are formed. A pitch of the protrusion and the recess is less than the average particle diameter or the average outer diameter of the particle or the particle aggregate constituting the powder, and the pitch of the protrusion and the recess is in a range of 1 μm or less and a ratio between the height of the protrusion and the recess and the pitch thereof is 0.0005 or more such that the particle or the particle aggregate is in point contact with the protrusion.

In addition, Japanese Patent Application Publication No. 2015-189030 discloses the invention relating to a powder adhesion prevention member which prevents adhesion of powder even when the particle diameter of the powder is small. Specifically, there is described the powder adhesion prevention member having a structure in which at least one surface of a base has a minute protrusion structure which includes a minute protrusion group in which a plurality of minute protrusions each formed of a hardened material having a resin composition are closely disposed, the average of distances between the adjacent minute protrusions is 500 nm or less, the cross-sectional area occupancy of a material portion forming the minute protrusion in a horizontal cross section when it is assumed that the minute protrusion is cut by a horizontal plane orthogonal to a depth direction of the minute protrusion gradually increases continuously with approach to the deepest portion of the minute protrusion from the top portion thereof, and the static contact angle of pure water on a surface on the side of the minute protrusion structure is 60° or less when it is measured by a half-angle method. Further, the Publication 2015-189030 describes that, with regard to the particle diameter of the powder to be handled, the powder adhesion prevention member can be suitably used for the powder having a particle diameter of 0.1 to 30 μm.

In addition, Japanese Patent Application Publication No. 2017-119902 discloses the invention relating to a powder adhesion prevention titanium member capable of preventing adhesion of powder while maintaining the strength of a surface which comes into contact with the powder. Specifically, there is described the powder adhesion prevention titanium member including a surface layer portion which is formed of any of nitride, carbide, and carbonitride, has a hardness higher than that of an internal portion, and has an uneven surface which comes into contact with the powder. The arithmetic average roughness Ra of the uneven surface is 0.4 μm or more and 2.0 μm or less, and the Vickers hardness of the surface layer portion is 400 or more. Further, the Publication 2017-119902 describes, with regard to the powder to be handled, a silver particle having a median diameter of 1.5 μn, a nickel particle having a median diameter of 2.5 μn, powder paint having a median diameter of 23 μm, and alumina having a median diameter of 8 μm in the example.

Japanese Patent Application Publication No. 2017-128101 discloses the invention relating to a powder adhesion prevention member capable of preventing adhesion of powder while maintaining the strength of a surface which comes into contact with the powder. Specifically, there is described the powder adhesion prevention member including a film which has nickel as the main ingredient (may further contain at least one of phosphorous, boron, tungsten, molybdenum, and cobalt) and has an uneven surface which comes into contact with the powder. The arithmetic average roughness Ra of the uneven surface is 0.2 μn or more and 1.6 μm or less, and the Vickers hardness of the film is 400 or more. Note that the Publication 2017-128101 describes that the film may contain an inorganic fine particle which displays abrasion resistance or a fine particle which displays lubricity, and describes, with regard to the powder to be handled, a silver particle having a median diameter of 1.5 μm, a copper particle having a median diameter of 22.3 μm, a PTFE particle having a median diameter of 0.3 μm, and an alumina particle having a median diameter of 8 μm in the example.

However, the inventions described in the Related Arts described above have the following problems.

First, the invention described in the U.S. Pat. No. 4,064,438 has a problem that the invention cannot be applied to powder having a size of more than 20 μm. For example, the size of edible flour is about 30 to 40 μm.

In addition, the invention described in the Publication 2015-189030 has a problem that an inorganic particle is not a target particle to be handled.

The invention described in the Publication 2017-119902 can be applied to a member made of titanium, but the invention has a problem that the invention cannot be applied to a member made of SUS (stainless steel) which is often used as the material of the powder handling apparatus.

The invention described in the Publication 2017-128101 has a problem that the film may peel off and become a foreign object.

Further, in each of the inventions described in the U.S. Pat. No. 4,064,438, the Publication 2015-189030, the Publication 2017-119902, and the Publication 2017-128101, the shape of the surface which comes into contact with the powder is determined by using a two-dimensional index (two-dimensional roughness parameter) which represents the state of unevenness of a cross section orthogonal to the surface.

When Kotaro Iida et al. "Measurement of the Adhesive Force between Particles and a Substrate by Means of the Impact Separation Method. Effect of the Surface Roughness and Type of Material of the Substrate" (Chem. Pharm. Bull. 41 (9) 1621-1625 (1993) https://www.jstage.jst.go.jp/article/cpb1958/41/9/41__9_1621/_pdf/-char/en) is taken as an example, it is reported that the adhesive force between a flat surface having a certain level of roughness and a single particle sharply decreases when the arithmetic average roughness Ra (two-dimensional roughness parameter) increases, and the adhesive force gradually decreases as the Ra increases from a specific numerical value.

In the present invention as well, the surface which comes into contact with powder needs two-dimensional roughness of a certain level or higher, and hence each of the existing techniques described above has the effect of reducing adhesion in the case where the powder is regarded as a single particle.

However, as the result of elaborate studies conducted by the inventors, it has been found that, at a site where powder is actually handled, powder flows on a hopper or a chute in a state in which the powder is not in the form of a single particle but in the form of a layer (particle layer), and hence it is necessary to consider surface contact between the particle layer and a contact surface (flat surface), and, in the case where consideration is given to the surface contact, a two-dimensional index (two-dimensional roughness parameter) such as a line roughness parameter (JIS B 0601) which is often used in existing theses and the above Related Arts is not adequate.

In view of the problems described above, the present invention has been made by focusing attention on three-dimensional roughness parameters of a surface (texture, in other words, inherent quality) with which powder comes into contact as the result of elaborate studies and researches described later, and an object thereof is to provide a powder-contacting member which prevents adhesion of powder even when the powder coming into contact with a surface is not only in the form of a single particle but also in the form of a layer (particle layer), and has high flowability, and a method for the surface treatment of a powder-contacting member.

SUMMARY OF THE INVENTION

In order to achieve the above object, a powder-contacting member according to the present invention having a surface with which powder comes into contact and on which surface treatment is performed, is characterized by that an arithmetic average peak curvature Spc (1/mm) of the surface is 150 to 400, a peak density Spd (piece/mm$^2$) of the surface is 10000 to 180000, a root mean square gradient Sdq of the surface is 0.05 to 0.30, and an arithmetic average height Sa (μm) of the surface is 0.02 to 3.00.

The powder-contacting member may be formed of a steel material or a ceramic material.

Preferably, the surface treatment is blasting process, however, it may be any of hand polishing, lapping, buffing, CMP, laser machining, etching, and cutting.

A method for surface treatment of a powder-contacting member according to the present invention having a surface with which powder comes into contact comprises:

performing surface treatment on the surface such that an arithmetic average peak curvature Spc (1/mm) of the surface is 150 to 400, a peak density Spd (piece/mm$^2$) of the surface is 10000 to 180000, a root mean square gradient Sdq of the surface is 0.05 to 0.30, and an arithmetic average height Sa (μm) of the surface is 0.02 to 3.00.

In the method of the present invention, it is preferable that the surface treatment is blasting process.

Preferably, an abrasive used in the blasting process is an elastic abrasive obtained by dispersing an abrasive grain into an elastic material or an elastic abrasive obtained by adhering an abrasive grain to a surface of a core formed of an elastic material.

Alternatively, an abrasive used in the blasting process may be a metal-based abrasive or a ceramic-based abrasive.

It is preferable that a particle size of the abrasive used in the blasting process is #30 to #20000.

Preferably, the abrasive used in the blasting process is ejected with an ejection pressure of 0.01 to 0.5 MPa and an ejection distance of 50 to 150 mm.

Other than the blasting process, the surface treatment may be any of hand polishing, lapping, buffing, CMP, laser machining, etching, and cutting.

Effect of the Invention

The powder-contacting member of the present invention described above includes the surface (texture) having the predetermined three-dimensional roughness parameters, whereby the powder-contacting member has an advantage that, not only in the case where the powder on the surface is in the form of the single particle but also in the case where the powder is in the form of the particle layer (layer form), adhesion is effectively prevented, flowability on the surface is improved, and the range of the particle size of the powder to the powder-contacting member can be widely applied.

In addition, the surface treatment for forming the surface (texture) having the three-dimensional roughness parameters defined in the present invention can be carried out by using existing means, and it is possible to treat easily in a short time period.

Further, the present invention has an advantage that the present invention can be applied to the powder-contacting member regardless of the material or shape of the powder-contacting member, and the present invention can also be applied even to an existing product (powder-contacting member) (it is only required that the surface having the three-dimensional roughness parameters defined in the present invention is formed by the surface treatment).

Furthermore, the present invention has an advantage that it is not necessary to form a film on the surface, i.e., it is not necessary to newly form a substance which may invite the mixing of a foreign object.

DETAILED DESCRIPTION OF THE PREFERRED EMBODIMENTS

Hereinbelow, an embodiment of the present invention will be described.

The present invention forms a surface (texture) having predetermined three-dimensional roughness parameters described later by performing surface treatment on the surface of a powder-contacting member which comes into contact with powder to prevent adhesion of the powder.

The powder-contacting member of the present invention is not particularly limited as long as the powder-contacting member is used in a portion with which powder comes into contact in a device or equipment which handles powder in supply, transport, or measure of the powder (e.g., a hopper or a chute). In addition, the powder-contacting member may be formed of, e.g., metal or ceramic.

Examples of the metal include stainless steel, a titanium alloy, an aluminum alloy, a nickel-based alloy, and various iron alloys, and examples of the ceramic include zirconia, alumina, silicon carbide, quartz, and glass.

In addition, as described above, in order to improve the effect of preventing adhesion of powder in the powder-contacting member, the present inventors have focused attention on three-dimensional roughness parameters on a surface with which the powder comes into contact, and have conducted elaborate studies. Based on knowledge obtained as a result, it has been found that, on the surface (texture) of the powder-contacting member, the number of contact points with powder which is in the form of a particle layer (layer form) is small, and the flow of the particle layer is improved by providing space where an air layer can exist between the particle layer and the surface.

In addition, it has been found that, however, when the curvature of a point where the particle layer and the flat surface come into contact with each other is high or sharp, the particle layer is easily snagged on the tip of the point, and hence a certain level of roundness (curvature) is necessary. Further, it has been found that, when the gradient of a peak on the surface (texture) is steep, frictional resistance tends to increase, and hence the gradient needs to have a certain level of gentleness. Furthermore, it has been found that, however, when the gradient is extremely or too moderate, the air layer cannot exist between the particle layer and the surface (texture surface), and hence the gradient needs to have a value in a specific range.

As the result of elaborate studies based on the above knowledge, it has been found that the surface (texture) with which the powder comes into contact has predetermined three-dimensional roughness parameters, i.e., from the viewpoint of powder adhesion prevention, it is preferable that an arithmetic average peak curvature Spc of the surface is 150 to 400, a peak density Spd thereof is 10000 to 180000, a root mean square gradient Sdq thereof is 0.05 to 0.30, and an arithmetic average height Sa thereof is 0.02 to 3.00.

Note that the arithmetic average peak curvature Spc (unit: 1/mm) is a parameter indicative of the average of the principal curvatures of peaks on the surface (i.e., the state of microscopic protrusions and recesses on the target surface is evaluated as the average of the curvatures of the peaks), and is defined in ISO25178.

The peak density Spd is a parameter indicative of the number of peaks per unit area, and is defined in ISO25178. When the value of Spd (unit: piece/mm$^2$) is large, it is usually suggested that the number of contact points with another object is large.

The root mean square gradient Sdq is a parameter calculated from the root mean square of gradients at all points in a defined area (i.e., corresponds to a parameter obtained by applying a root mean square gradient Rdq on a roughness curve to the surface), and is defined in ISO25178.

The arithmetic average height Sa (unit: μm) is a parameter indicative of the average of absolute values of height differences between the individual points and the average surface of the surface (i.e., corresponds to a parameter obtained by applying an arithmetic average height Ra of the roughness curve to the surface), and is defined in ISO25178.

The units described above are identical to the units of the three-dimensional roughness parameters described in the present specification.

Next, a method for surface treatment for forming the surface (texture) of the present invention described above will be followed. Note that, in the present invention, it is possible to use various surface treatment methods.

First, an example of the surface treatment used in the present invention includes blasting process.

In the blasting process, the surface (texture) having the predetermined three-dimensional roughness parameters of the present invention described above is formed by using one or more of abrasives described below.

It is possible to use various abrasives as the abrasive used in the blasting process and, for example, a metal-based abrasive, a ceramic-based abrasive, and an elastic abrasive are suitably used.

Specifically, examples of the material of the metal-based abrasive include steel, high-speed steel, stainless steel, and iron chromium boron, and examples of the material of the ceramic-based abrasive include alumina, zirconia, zircon, silicon carbide, and glass.

The elastic abrasive includes an elastic abrasive obtained by dispersing abrasive grains into an elastic body (base material) such as rubber or elastomer ["SIRIUS" (registered trademark) manufactured by Fuji Manufacturing Co., Ltd.] or an elastic abrasive obtained by causing the surface of the elastic body to carry abrasive grains ["SIRIUS Z" (registered trademark) manufactured by Fuji Manufacturing Co., Ltd.]. Note that the elastic abrasive obtained by causing the surface of the elastic body to carry abrasive grains may also be an elastic abrasive obtained by adhering and fixing abrasive grains to the surface of the elastic body having self-adhesion. Alternatively, an elastic abrasive obtained by adhering and fixing abrasive grains to the surface of the elastic body after an adhesive is applied to the surface of the elastic body.

In addition, as the above-described elastic abrasive obtained by dispersing abrasive grains into the elastic body (base material), there may be used, e.g., an elastic abrasive obtained by blending and dispersing 10 to 90 wt % of abrasive grains into 90 to 10 wt % of a base material serving as the elastic body, an elastic abrasive obtained by blending 70 wt % or more of the abrasive grains into the base material, and an elastic abrasive obtained by further adding and blending a coloring material such as dye or pigment to each elastic abrasive described above, or by adding and blending a fluorescent coloring agent and/or an aromatic and an antimicrobial agent to each elastic abrasive described above in addition to the coloring material.

In addition, as the above-described elastic abrasive obtained by causing the surface of the elastic body to carry abrasive grains, there may be used, e.g., an elastic abrasive which includes a core having a rubber hardness of 30 or less and a predetermined particle diameter and made from a crosslinked polyrotaxane compound having self-adhesion, and an abrasive grain layer formed on the surface of the core, and in which the abrasive grain layer has a masonry structure of a plurality of abrasive grains which have an average particle diameter of 0.1 μm to 12 μm and are bonded to each other in a thickness direction by the crosslinked polyrotaxane compound, an elastic abrasive in which the compression set of the core is 5% or less, and the vibration absorption property of 1 Hz to 100 kHz (tan δ) is 0.3 or more, an elastic abrasive in which the thickness of the abrasive grain layer is less than ¼ of the minor axis of the elastic abrasive, an elastic abrasive in which the rubber hardness of the core is 10 or less, an elastic abrasive in which the compression set of the core is 1% or less, an elastic abrasive in which the crosslinked polyrotaxane compound is obtained by crosslinking one compound selected from among polycarbonate diol and acrylate copolymers, and polyrotaxane, an elastic abrasive in which the crosslinked polyrotaxane compound is crosslinked by using a crosslinker including an isocyanate compound, an elastic abrasive in which the polyrotaxane is obtained by causing polyethylene glycol to pass through the opening of a α-cyclodextrin molecule and coupling an adamantane group to each end of the polyethylene glycol, an elastic abrasive in which part of a hydroxyl group of the α-cyclodextrin molecule is substituted by a polycaprolactone group, and an elastic abrasive in which a silane coupling agent is blended into the crosslinked polyrotaxane compound.

The shape of the abrasive described above is not particularly limited, and it is possible to use a spherical abrasive or an abrasive having no regular shape. With regard to the size of the abrasive, an abrasive having a size which falls within a range of #30 (500 μm to 600 μm JIS R 6000-1 2017 sieve analysis test sieve three stages+fourth stage) to #20000 [0.5 μm (median diameter D50): measurement by a laser diffraction scattering method (measurement apparatus: Microtrac X100 manufactured by MicrotracBEL Corp.)] is suitably used.

In addition, in the blasting process used as the surface treatment of the present invention, a compressed-gas-type sandblasting apparatus is suitably used.

The compressed-gas-type sandblasting apparatus ejects an abrasive (medium) toward a workpiece by using energy of compressed gas (air, argon, or nitrogen) with a nozzle to perform treatment.

Examples of the compressed-gas-type sandblasting apparatus include a suction-type blasting apparatus which sucks the abrasive with negative pressure generated by compressed gas ejection and ejects the abrasive together with compressed air (example: SFK-2 manufactured by Fuji Manufacturing Co., Ltd.), a gravity-type blasting apparatus which ejects the abrasive falling from a tank with compressed air which carries the abrasive (example: SGF-4 manufactured by Fuji Manufacturing Co., Ltd.), a direct-pressure-type blasting apparatus in which compressed gas is supplied into a tank into which the abrasive is charged, the abrasive transported from the compressed gas in the tank is carried by flow of additionally provided compressed air, and the abrasive is ejected from a blast gun (example: FDQ-2 manufactured by Fuji Manufacturing Co., Ltd.), and a blower-type blasting apparatus in which the direct-pressure-type compressed gas is generated by a blower unit and is ejected (example: LDQ-2 manufactured by Fuji Manufacturing Co., Ltd.).

With regard to blasting ejection conditions in the case where the above-described blasting apparatus is used, as an example, an ejection pressure is preferably 0.04 MPa to 0.6 MPa, and an ejection distance is preferably 50 to 150 mm.

In addition, as the surface treatment of the present invention, surface treatment methods other than the above-described blasting process may also be used, and the surface shape (texture) having the three-dimensional roughness parameters defined in the present invention may be formed by using, e.g., various polishing processes (hand polishing, lapping, buffing, and CMP), laser machining, etching, and cutting.

A surface having the three-dimensional roughness parameters defined in the present invention was actually formed by performing the surface treatment on the surface with which powder came into contact, and a determination test of the effect of preventing powder adhesion to the surface was performed. The result of the determination test is shown below.

With regard to a test method, the surface treatment was performed on each of workpieces (Examples 1 to 4) serving as test targets and the surface having the predetermined three-dimensional roughness parameters of the present invention was thereby formed, and the effect of preventing the adhesion of the powder to the surface was then observed.

Note that, with regard to a method for measuring the surface roughness after the surface treatment, in the present examples, the measurement was performed with a measurement magnification of 1000 times by using a shape analysis laser microscope (VK-X250 manufactured by KEYENCE CORPORATION.). Subsequently, roughness analysis was performed on measured data by using the supplied analysis software of the laser microscope "multifile analysis application VK-H1XM". With regard to the analysis, first, a reference surface setting (the reference surface setting creates a surface on which a reference surface height is zero from height data with the least squares method) was performed by using an "image processing" function, and the three-dimensional roughness parameters were then calculated in a surface roughness mode.

The content of the surface treatment performed on the workpiece, the roughness parameters of the surface, the type of powder for determining whether powder adhesion was prevented, and the result of observation (effect) were summarized for each workpiece in Tables 1 to 4 shown below.

Content and Observation Result of Example 1

| | |
|---|---|
| Workpiece | Hopper for food production line (material: SUS304) |
| Workpiece size | Inner diameter 470 mm, Height 410 mm |
| Powder | Flour |
| Particle diameter | 37 μm |
| Treatment method | Blasting process |
| Roughness parameters | Sa = 1.5 Spc = 180 Spd = 27678 Sdq = 0.147 |
| Effect | Adhesion to the hopper was reduced. |

Content and Observation Result of Example 2

| | |
|---|---|
| Workpiece | Chute for powder transport (material: SUS304) |
| Workpiece size | L 400 mm, Height 40 mm, V shape |
| Powder | Aluminum hydroxide |
| Average particle diameter | 70 μm |
| Treatment method | Blasting process |
| Roughness parameters | Sa = 3.0 Spc = 209 Spd = 16483 Sdq = 0.264 |
| Effect | An improvement in the flow of the powder solved the problem that the powder was partially adhered and the flow was stopped. |

Content and Observation Result of Example 3

| | |
|---|---|
| Workpiece | Screw for powder transport (material: SUS304) |
| Workpiece size | ϕ25 mm × L 400 mm |
| Powder | Barium titanate |
| Particle diameter | 3 μm |
| Treatment method | Blasting process |
| Roughness parameters | Sa = 0.025 Spc = 370 Spd = 159240 Sdq = 0.072 |
| Effect | The problem that adhesion to the screw was progressively increased and the supply amount |

-continued

| Content and Observation Result of Example 3 |
|---|
| was not maintained was solved. |

| Content and Observation Result of Example 4 | |
|---|---|
| Workpiece | Hopper for powder transport (material: SUS304) |
| Workpiece size | Inner diameter ϕ300 mm, Height 270 mm |
| Powder | Powder for pill |
| Particle diameter | 29 μm |
| Treatment method | Blasting process |
| Roughness parameters | Sa = 0.5 Spc = 193 Spd = 22675 Sdq = 0.151 |
| Effect | Adhesion to a wall surface of the hopper was reduced. Occurrence of a rathole was also reduced. |

As shown in Tables 1 to 4, in the workpiece (powder-contacting member) in which the surface having the predetermined three-dimensional roughness parameters of the present invention was formed by the surface treatment, the effect of preventing powder adhesion was observed.

Thus the broadest claims that follow are not directed to a machine that is configure in a specific way. Instead, said broadest claims are intended to protect the heart or essence of this breakthrough invention. This invention is clearly new and useful. Moreover, it was not obvious to those of ordinary skill in the art at the time it was made, in view of the related art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

The invention claimed is:

1. A surface treatment method for preventing adhesion of powder to a powder-contacting member, the method comprising:

performing surface treatment on a surface of the powder contacting member, on which contacted powder flows in the form of a particle layer such that an arithmetic average peak curvature Spc (1/mm) of the surface is 150 to 400, a peak density Spd (piece/mm$^2$) of the surface is 10000 to 180000, a root mean square gradient Sdq of the surface is 0.05 to 0.30, and an arithmetic average height Sa (μm) of the surface is 0.02 to 3.00, and providing a space where an air layer can exist between the particle layer and the surface.

2. The method for surface treatment of a powder-contacting member according to claim 1, wherein the surface treatment is blasting process.

3. The method for surface treatment of a powder-contacting member according to claim 2, wherein an abrasive used in the blasting process is an elastic abrasive obtained by dispersing an abrasive grain into an elastic material or an elastic abrasive obtained by adhering an abrasive grain to a surface of a core formed of an elastic material.

4. The method for surface treatment of a powder-contacting member according to claim 2, wherein an abrasive used in the blasting process is a metal-based abrasive or a ceramic-based abrasive.

5. The method for surface treatment of a powder-contacting member according to claim 2, wherein a particle size of the abrasive used in the blasting process is #30 to #20000.

6. The method for surface treatment of a powder-contacting member according to claim 3, wherein a particle size of the abrasive used in the blasting process is #30 to #20000.

7. The method for surface treatment of a powder-contacting member according to claim 4, wherein a particle size of the abrasive used in the blasting process is #30 to #20000.

8. The method for surface treatment of a powder-contacting member according to claim 2, wherein the abrasive used in the blasting process is ejected with an ejection pressure of 0.01 to 0.5 MPa and an ejection distance of 50 to 150 mm.

9. The method for surface treatment of a powder-contacting member according to claim 3, wherein the abrasive used in the blasting process is ejected with an ejection pressure of 0.01 to 0.5 MPa and an ejection distance of 50 to 150 mm.

10. The method for surface treatment of a powder-contacting member according to claim 4, wherein the abrasive used in the blasting process is ejected with an ejection pressure of 0.01 to 0.5 MPa and an ejection distance of 50 to 150 mm.

11. The method for surface treatment of a powder-contacting member according to claim 5, wherein the abrasive used in the blasting process is ejected with an ejection pressure of 0.01 to 0.5 MPa and an ejection distance of 50 to 150 mm.

12. The method for surface treatment of a powder-contacting member according to claim 1, wherein the surface treatment is any of hand polishing, lapping, buffing, CMP, laser machining, etching, and cutting.

* * * * *